United States Patent [19]

Benko et al.

[11] Patent Number: 5,027,922

[45] Date of Patent: Jul. 2, 1991

[54] VERTICALLY MOVABLE SAFETY RAILING

[76] Inventors: John C. Benko, 1457 Hunters Chase Dr., Westlake, Ohio 44145; Ronald J. Guerra, 3710 Hull Rd., Huron, Ohio 44839

[21] Appl. No.: 396,668

[22] Filed: Aug. 22, 1989

[51] Int. Cl.[5] ..... E04G 1/18; E04G 1/26

[52] U.S. Cl. ..... 182/113; 182/141

[58] Field of Search ..... 182/113, 115, 148, 141

[56] References Cited

U.S. PATENT DOCUMENTS

| | | | |
|---|---|---|---|
| 2,726,123 | 12/1955 | Mathews | 182/113 |
| 4,371,056 | 2/1983 | Arglade | 182/113 X |
| 4,572,328 | 2/1986 | Benko | 182/113 X |
| 4,679,657 | 7/1987 | Bennett et al. | 182/113 |
| 4,787,111 | 11/1988 | Pacek et al. | 182/113 X |

*Primary Examiner*—Karen J. Chotkowski

*Attorney, Agent, or Firm*—Renner, Otto, Boisselle & Sklar

[57] ABSTRACT

A vertically movable safety railing system for providing a safety railing enclosed area on top of mobile equipment such as railroad tank cars, tank trucks, and the like, characterized by an elevated stationary platform and a safety railing assembly mounted relative to the platform. The safety railing assembly includes a vertically movable mast, a cantilever arm attached to the mast, a vertical movement unit and an open-bottomed safety railing cage secured to the arm. The vertical movement unit includes either a pneumatic or electric motor operated jack, or alternatively a hydraulic piston-cylinder assembly. These vertical movement units act as means for vertically moving the mast relative to the structural member or platform between an elevated position where the safety railing cage is elevated above the mobile equipment and a lower position where the safety railing frame substantially contacts the equipment, enclosing a portion of the top of the equipment to provide a safety railing enclosed area.

20 Claims, 7 Drawing Sheets

VERTICALLY MOVABLE SAFETY RAILING

DISCLOSURE

This invention relates to a safety railing, and more specifically to a vertically adjustable safety railing system for obtaining safety railing enclosed access to the tops of mobile equipment of various heights such as tank trucks and railroad tank and hopper cars.

BACKGROUND OF THE INVENTION

For many years various governmental agencies such as the Occupational Safety and Health Administration (OSHA) have been actively promulgating regulations designed to create a healthier, safer environment for the industrial worker. In particular, regulations have focused upon the methods and equipment used in the loading and servicing of mobile equipment such as tank trucks and railroad tank and hopper cars. Various attempts have been made to conform with the requirements of these regulations. A safety platform for access to the top of mobile equipment is disclosed in U.S. Pat. No. 4,572,328, filed Mar. 14, 1985. The platform is not necessarily compatible with existing stationary platforms since both the railing and platform move vertically. Many loading platforms exist which may include safety railings but which require a worker to step from the platform onto the top of a truck, tank car or hopper car. The existence of such platforms which are usually stationary has tended to discourage the use of the invention disclosed in such prior patent in that the platform would require replacement or significant modification. Accordingly there is a need for a railing system which can be used with existing loading platforms. The present invention, in an attempt to conform with the requirements of OSHA regulations while taking advantage of existing platforms, provides an improved safety railing system for accessing the tops of various types of mobile equipment utilizing existing platforms.

SUMMARY OF THE INVENTION

In the present invention, a vertically movable safety railing system for providing a safety railing enclosed area on top of mobile equipment such as railroad tank cars, tank trucks, and the like is provided. The system includes an elevated stationary platform, and a vertically extending structural member. A safety railing assembly is movably mounted to the structural member whereby the safety railing assembly may be vertically moved relative to the structural member. The safety railing assembly includes a mast movably mounted to the structural member, a cantilever arm attached to the mast, a vertical movement unit and an openbottomed safety railing cage secured to the arm. The vertical movement unit includes either a pneumatic or electric motor operated jack, or alternatively a hydraulic piston-cylinder assembly. These vertical movement units act as means for vertically moving the mast relative to the structural member between an elevated position where the safety railing cage is elevated above the mobile equipment and a lower position where the safety railing frame contacts the equipment, enclosing a portion of the top of the equipment to provide a safety railing enclosed area.

Basically, the safety railing system is operated by first moving the mast to the elevated position and thereby providing maximum clearance for the mobile equipment that is to be serviced. After determining that sufficient clearance exists, the mobile equipment is then maneuvered beneath the safety railing assembly and adjacent the stationary platform. The safety railing cage is lowered until it lightly touches the top of the mobile equipment providing an enclosed area. Finally, prior to moving the piece of mobile equipment, the safety railing cage may be once again raised to the topmost position for vehicle clearance.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
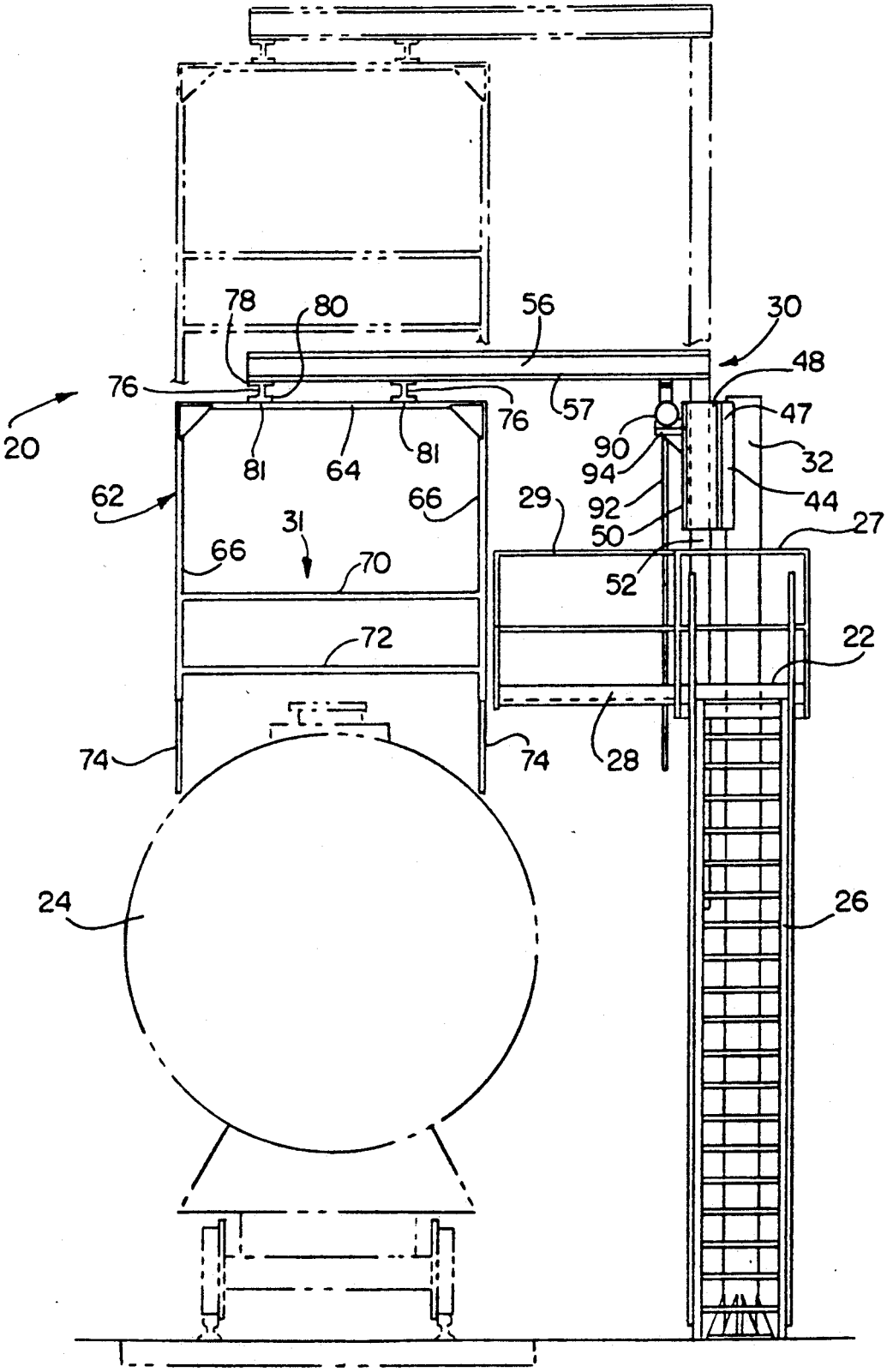
FIG. 1 is an end view of one preferred embodiment of the safety railing system of the present invention in position over a railroad tank car.

Referring in detail to the drawings and initially to FIG. 1, a vertically movable safety railing system 20 made in accordance with the present invention is shown. This system 20 includes an existing stationary platform 22 located above the top of a tank railroad car 24. Access to the platform 22 is obtained by a conventional stairway 26. At least two sides of the stationary platform 22 are surrounded by platform railing 27. A horizontally folding or telescoping gangway 28 with gangway rails 29 is attached to stationary platform 22. The system 20 includes a safety railing assembly 30 which provides a safety railing enclosed area 31 on top of the tank railroad car 24. Folding gangway 28 may be extended from platform 22 to form a walkway between the platform and the enclosed area 31.

Figure 2:
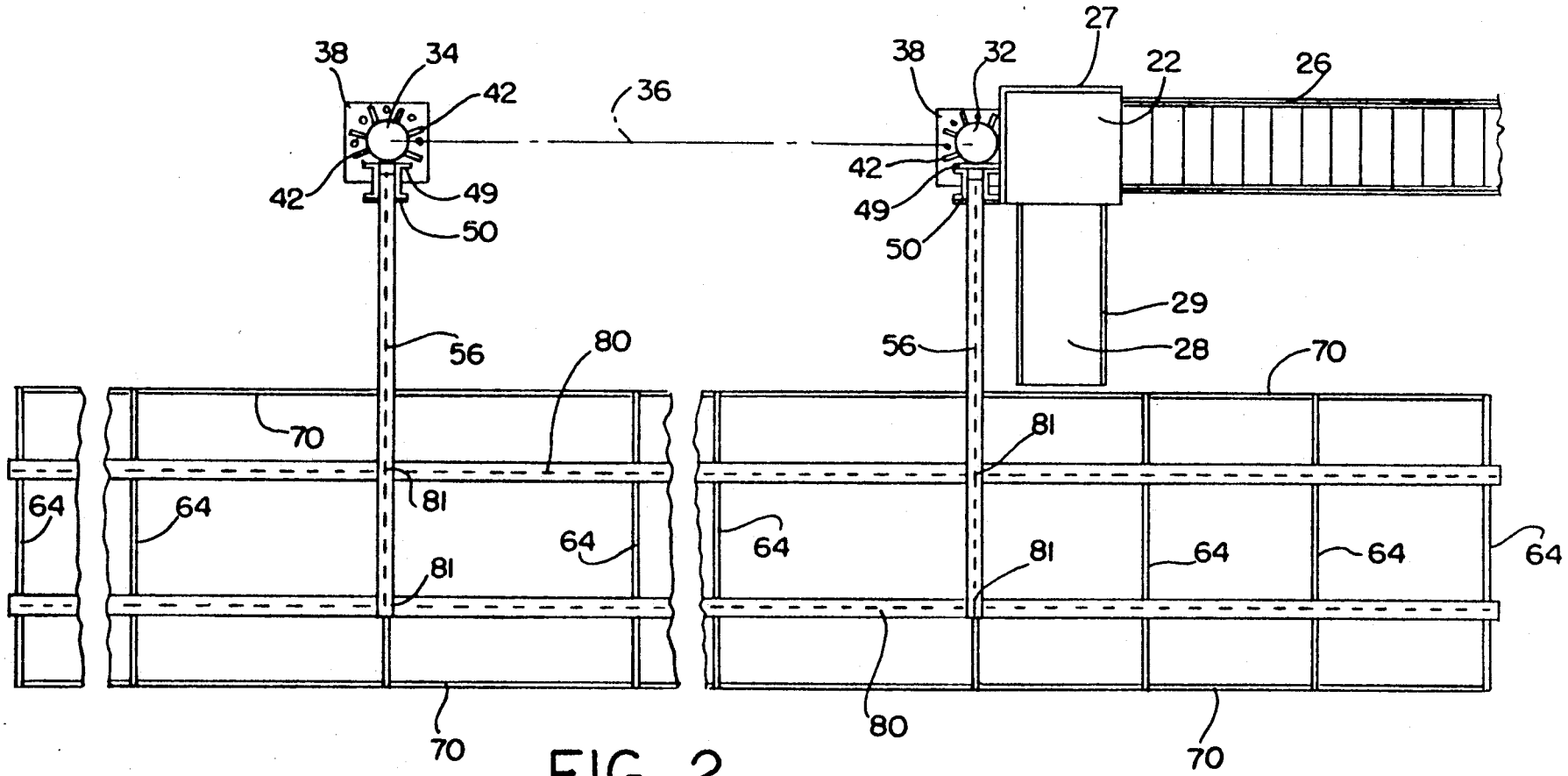
FIG. 2 is a top elevation of the safety railing system of FIG. 1 without the tank car.
Figure 3:
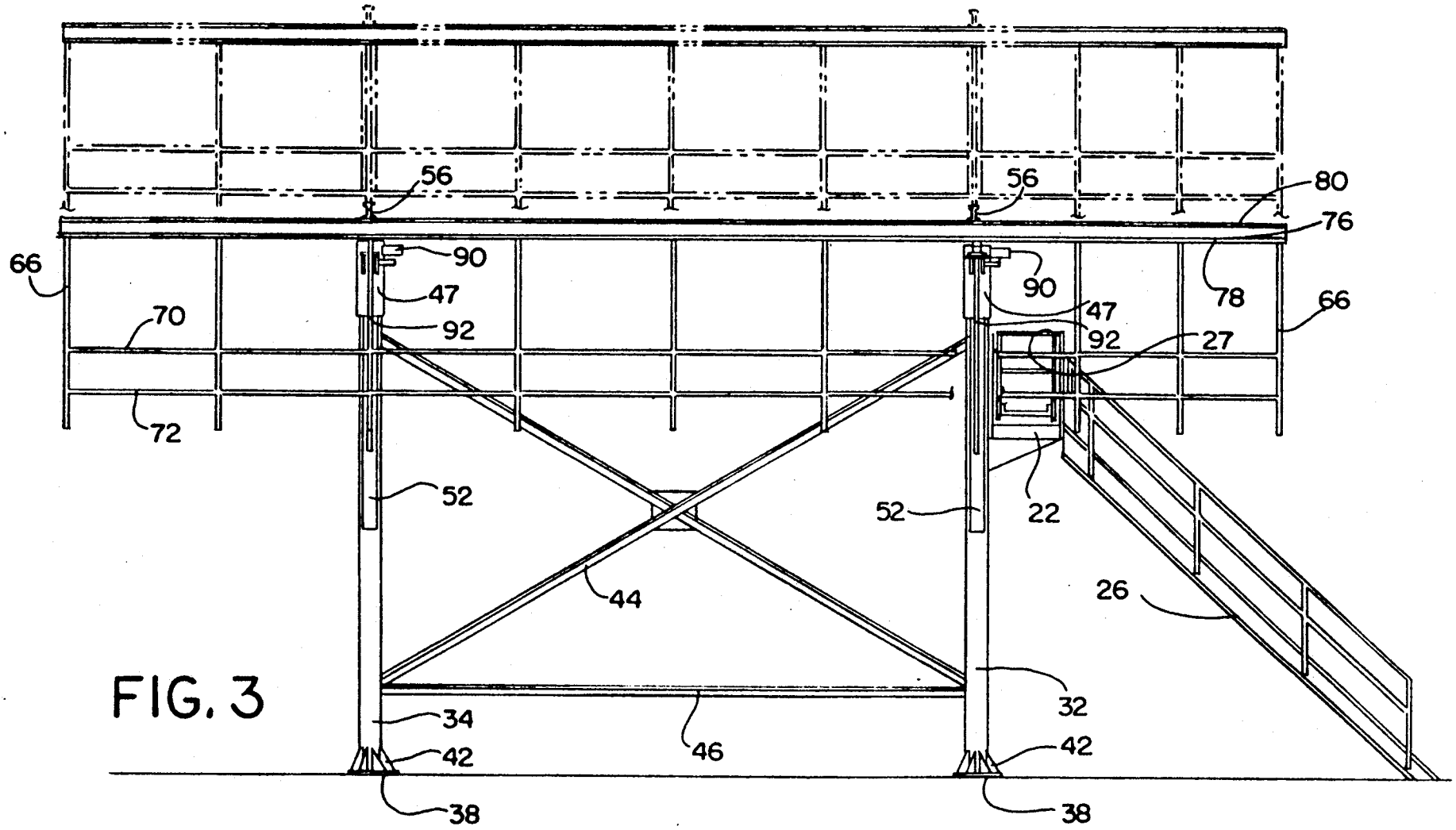
FIG. 3 is a side elevation view of the safety railing system of FIG. 1 without the tank car.

Referring now additionally to FIGS. 2 and 3, the safety railing system 20 also includes vertical structural member 32 positioned near the stationary platform 22. Member 32 may or may not be part of the platform structure. A second vertical structural member 34 is positioned a distance away from member 32. Both structural member 32 and structural member 34 have circular sections in the illustrated embodiment. The positioning of the components of the system 20 relative to each other is best explained by drawing an imaginary line 36 between the center axes of members 32 and 34. As is best seen in FIG. 2 folding gangway 28 is perpendicular to line 36. The distance between the two vertical structural members is preferably half the length of the desired enclosed safety area 31.

Structural members 32 and 34 are each provided with a base plate 38. The base plates 38 are interconnected by gussets 42 to the members 32 and 34. The base plate 38 is secured as by bolting to a concrete footer or pad (not shown). The members 32 and 34 are braced together by X-bracing 44 and also horizontal brace 46 (see FIG. 3).

The safety railing assembly 30 includes carriers 47 which are mounted to the upper end of structural members 32 and 34. The carriers 47 are basically a rectangular housing with a hollow center 48, an inner flange 49 and an outer flange 50. The inner flange 49 is welded, bolted or otherwise secured to the structural members 32 and 34. The outer flange 50 is attached to the vertical movement unit 51.

Safety railing assembly 30 also includes vertical masts 52. The vertical masts 52 extend through hollow centers 48 of the carriers 47. The vertical masts are also movably mounted to the vertical movement units 51. By being so mounted, the masts 52 may move vertically relative to the structural members 32 and 34. Cantilever arms 56 are rigidly secured to the top of the mast 52. The arms 56 are horizontal and extend perpendicularly outward from the mast 52 and are also perpendicular to the line 36. The cantilever arms are preferably I-beams with a lower flange 57 secured to the mast 52.

The safety railing assembly 30 also includes railing sections which together form a rectangular frame 62 or "cage" with an open bottom. The rectangular frame 62 includes several horizontal top rail sections 64, several vertical side rail sections 66 and a pair of horizontal handrails 70 and 72. The horizontal top rail sections 64 are horizontal and positioned parallel to the cantilever arm 56. The top rail sections 64 extend the width of the rectangular frame 62 and one top rail section is positioned at each end of the rectangular frame 62. The top rail sections 64 are preferably separated by intervals of 7½ feet or less. Vertical rail sections 66 extend perpendicularly downward from each top rail section 64 approximately 8 feet on each side. The lower end of each vertical rail section 66 may include cushioned end 74. Triangular braces 75 may be welded to the corner formed between vertical rail sections 66 and top rail sections 64 for structural stability. Transversing the vertical rail sections 66 are horizontal rails 70 and 72, which are welded to the vertical rail sections. The upper horizontal rail 70 is approximately 42 inches from the bottom end of the vertical railing. The lower horizontal rail 72 is approximately 21 inches from the bottom end. Thus there is about a 21-inch space between the upper and lower horizontal rails 70 and 72. The horizontal rails may include a gate or opening (not shown) adjacent the entrance from the folding gangway 28.

Cantilever arms 56 are secured to the top horizontal rail section 64 by two top members 78. The top members extend the length of rectangular frame 62 or the horizontal top rail sections 64. Because of the positioning of structural members 32 and 34, half the top member 78 (and attached frame 62) extends between cantilever arms. Extended on each side of the cantilever arms 56 is a quarter of the length of the top members 78 and the rectangular railing frame 62.

Turning now to details of the vertical movement unit 51, the unit includes reversable motor 90 which drives worm gear screw jack 92. The motor 90 and the jack 92 are supported on shelves 94 mounted on the outer flange 50 of carrier 47. The jack 92 is secured to the lower flange 57 of the cantilever arm 56. The motor 90 powers or drives the worm gear screw jack 82 which in turn vertically moves the cantilever arm 56 and attached railing frame 62. The motor 90 is preferably rated at 1 hp and 1140 rpm, and may be either electric or pneumatic activated. The motor 90 may be controlled from control boxes (not shown), preferably one at ground level and one on the existing stationary platform 22. The worm gear screw jack 92 is dimensioned so that the vertical unit 51 may move the safety railing assembly 30 between a lower position and an elevated position. At the lower position, the cushioned ends 74 of the vertical safety railing sections 66 contact the top of the tank car 24 (approximately 14 feet above ground level). At the elevated position, the safety railing system 30 is elevated above the car 24 as shown by dashed lines in FIGS. 1–3 (roughly 22 feet above ground level).

Vertical movement unit 51 may include lever limit switches (not shown) for limiting vertical movement of the unit. Additionally or alternatively, pressure switches (not shown) which stop downward movement of the system when contact is made with the vehicle may be employed.

Figure 4:
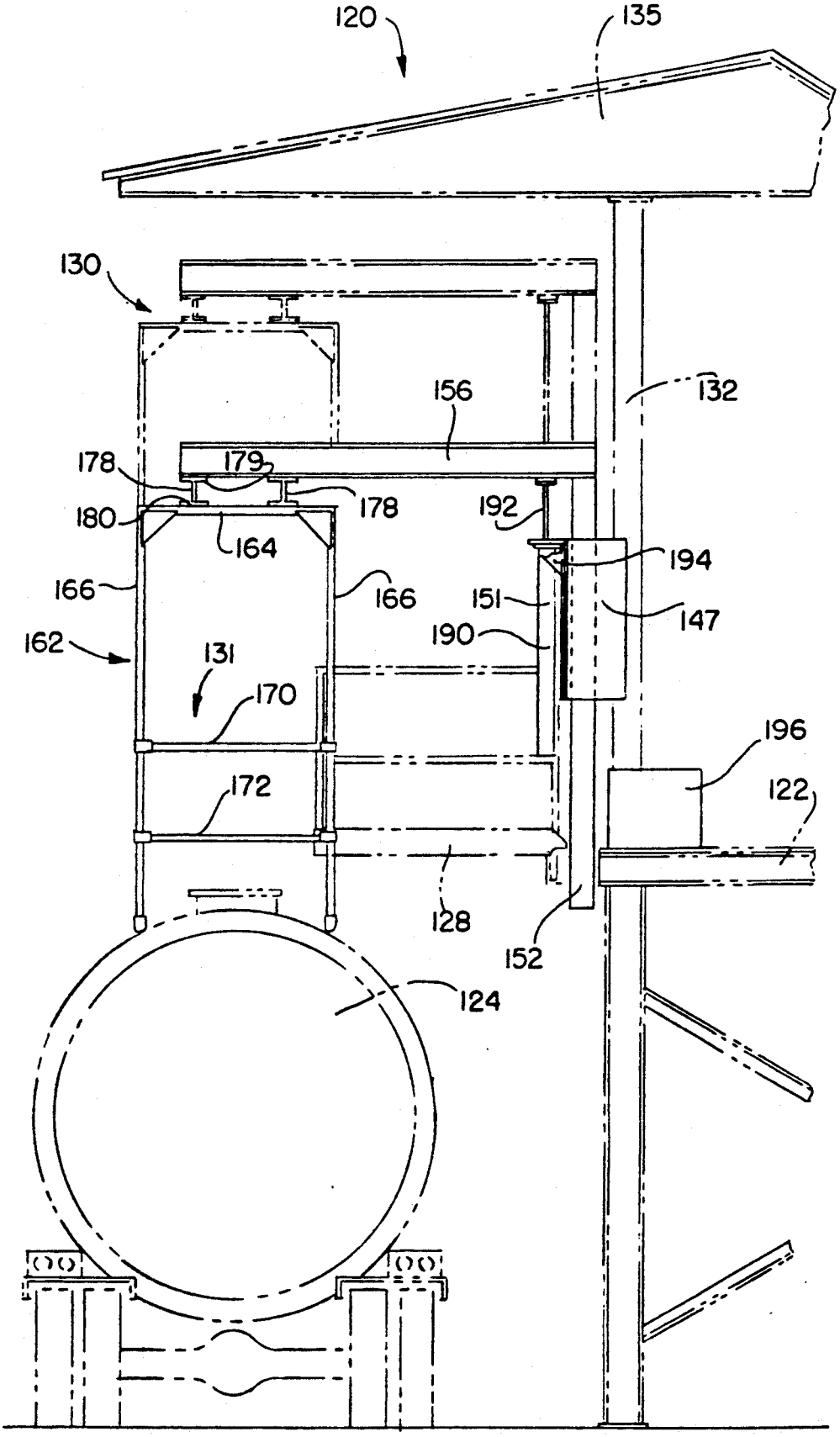
FIG. 4 is an end view of another preferred embodiment of the safety railing system of the present invention positioned over a tank truck.
Figure 5:
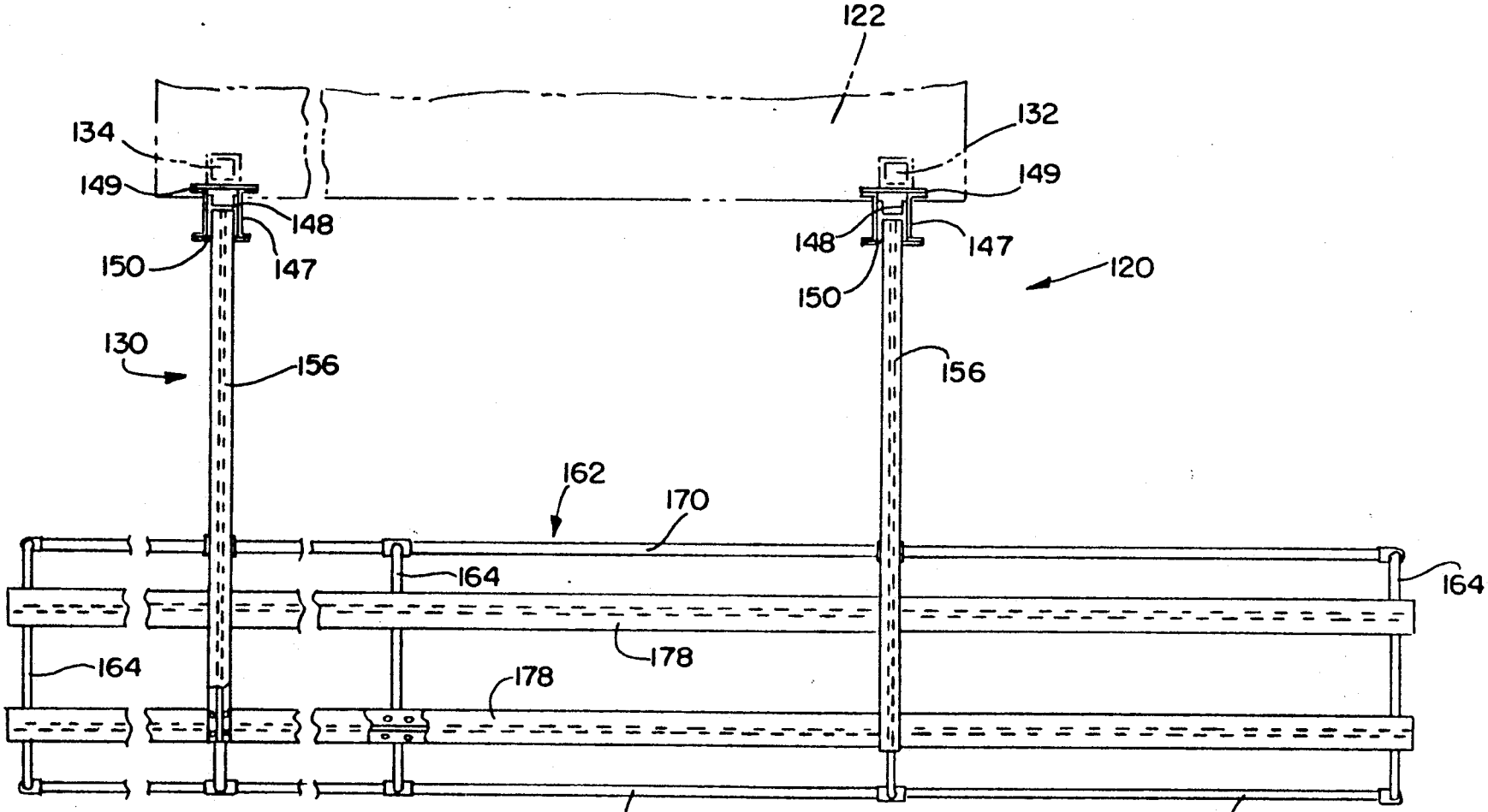
FIG. 5 is a top elevation view of the safety railing system of FIG. 4 without the truck and without the canopy shown in FIG. 4.
Figure 6:
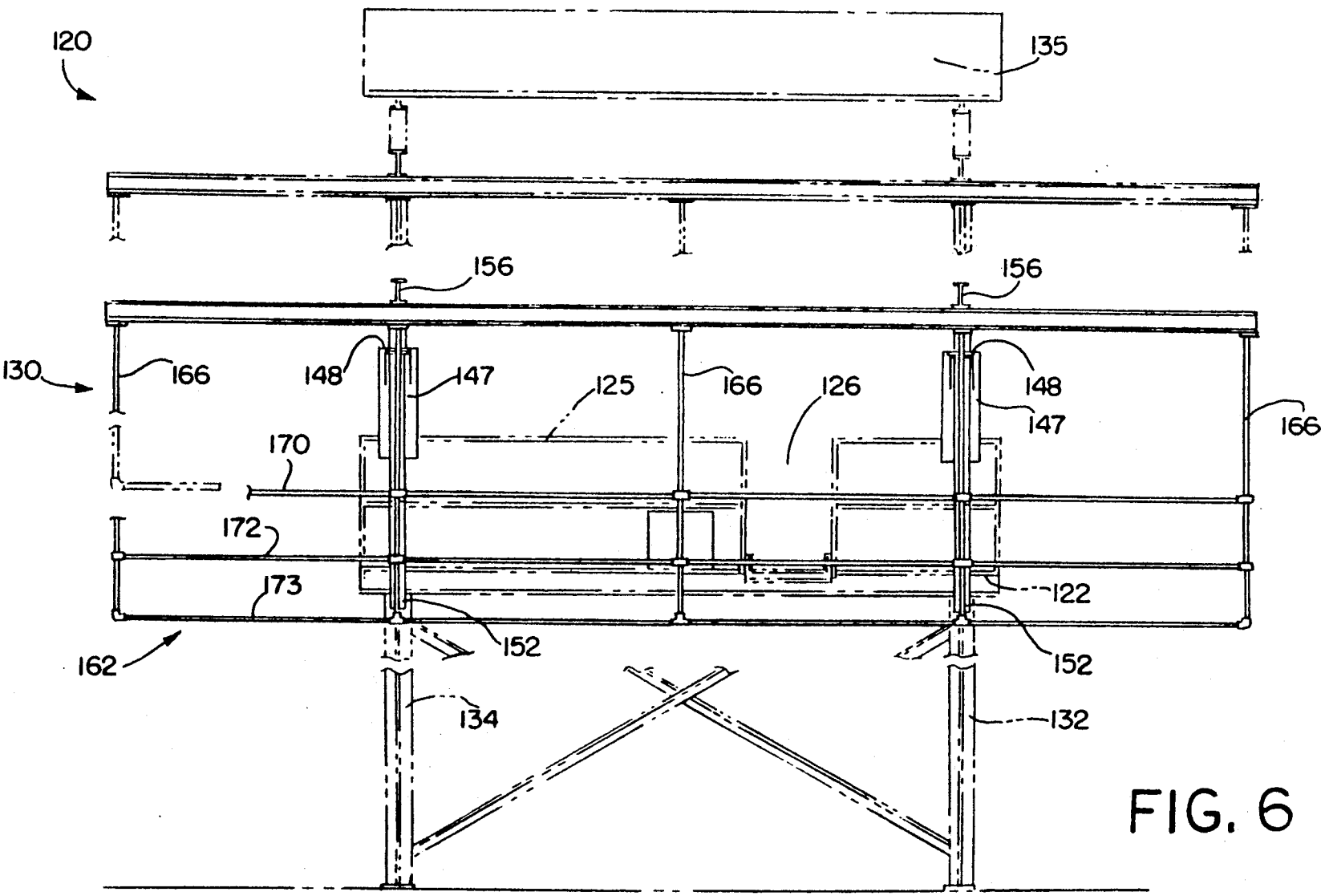
FIG. 6 is a side elevation view of the safety railing system of FIG. 4 without the truck.

Referring now additionally to FIGS. 4–6 there is illustrated a safety railing system 120 of somewhat different configuration than that illustrated in FIG. 1. An existing stationary platform 122 is located above a tank truck 124. The platform 122 includes platform railing 125 surrounding the platform, with a front opening 126. Attached to the platform 122 is a horizontally folding or telescoping gangway 128. A safety railing assembly is mounted in close proximity to the stationary platform 122 and forms a safety railing enclosed area 131 on top of the tank truck 124.

The stationary platform 122 includes vertical structural members 132 and 134 extending above the platform. Attached to the upper end of the structural members 132 and 134 is a canopy 135 extending generally horizontally over tank truck 124. The structural members 132 and 134 are square in section.

The safety railing assembly unit includes carriers 147 mounted by welding or otherwise to an intermediate portion of the structural members 132 and 134. Carrier 147 is similar to carrier 47 of the previous embodiment. The carrier 147 has a hollow center 148, an inner flange 149, and an outer flange 150. The inner flange 149 is secured to a front side of structural members 132 and 134. The outer flange 150 is secured to vertical movement unit 151. A vertical mast 152, similar to that of the previous embodiment, extends through the hollow center 148 of the carrier 147, and is movably mounted to the vertical movement unit 151. A cantilever arm 156 is attached to the top end of the mast 152.

Safety railing assembly 130 includes a rectangular frame 162 having several horizontal top rail sections 164 approximately 3½ feet in width. The frame also has several vertical rail side sections 166 extending perpendicularly downward roughly 8 feet from the top of rail sections 164. Transversing the vertical rail side sections are upper horizontal handrails 170 and low horizontal handrails 172. The rectangular frame 162 also includes bottom horizontal rail sections 173, connecting the base of the vertical rail sections 166 on the two sides of the rectangular frame running the length of the truck 124 (see FIG. 6). However horizontal rails 170 and 172 are not welded to the vertical side sections 166. Instead the horizontal rails 170 and 172 are connected to the vertical rail side sections by clamp type fittings 174.

Cantilever arms 156 are secured to the top horizontal rail section 164 by two top members 178, preferably I-beams with upper flanges 179 and lower flanges 180.

The vertical movement unit includes a hydraulic cylinder 190 with a piston 192. The cylinder 190 is supported on shelf 194 mounted to outer flange 150 of carrier 147. The piston 192 is secured to the lower flange 157 of cantilever arm 156. A hydraulic pump-/reservoir unit 196 is located on existing platform 122. The unit 196 provides necessary fluid pressure to the hydraulic cylinder 190. The illustrated unit 192 is designed to provide vertical movement of approximately 3½ feet. When the piston 192 is retracted, the system 120 will be in a position whereat the vertical rail section 166 contacts the top of the tank truck 124. When fluid pressure is supplied to the hydraulic cylinder 190 by way of hydraulic pump/reservoir unit 196, the piston 192 will extend and the mast will be moved vertically upward to a position indicated by dashed lines in the figures. When the fluid pressure is released, the piston 192 will retract and the mast 152 will be lowered.

Figure 7:
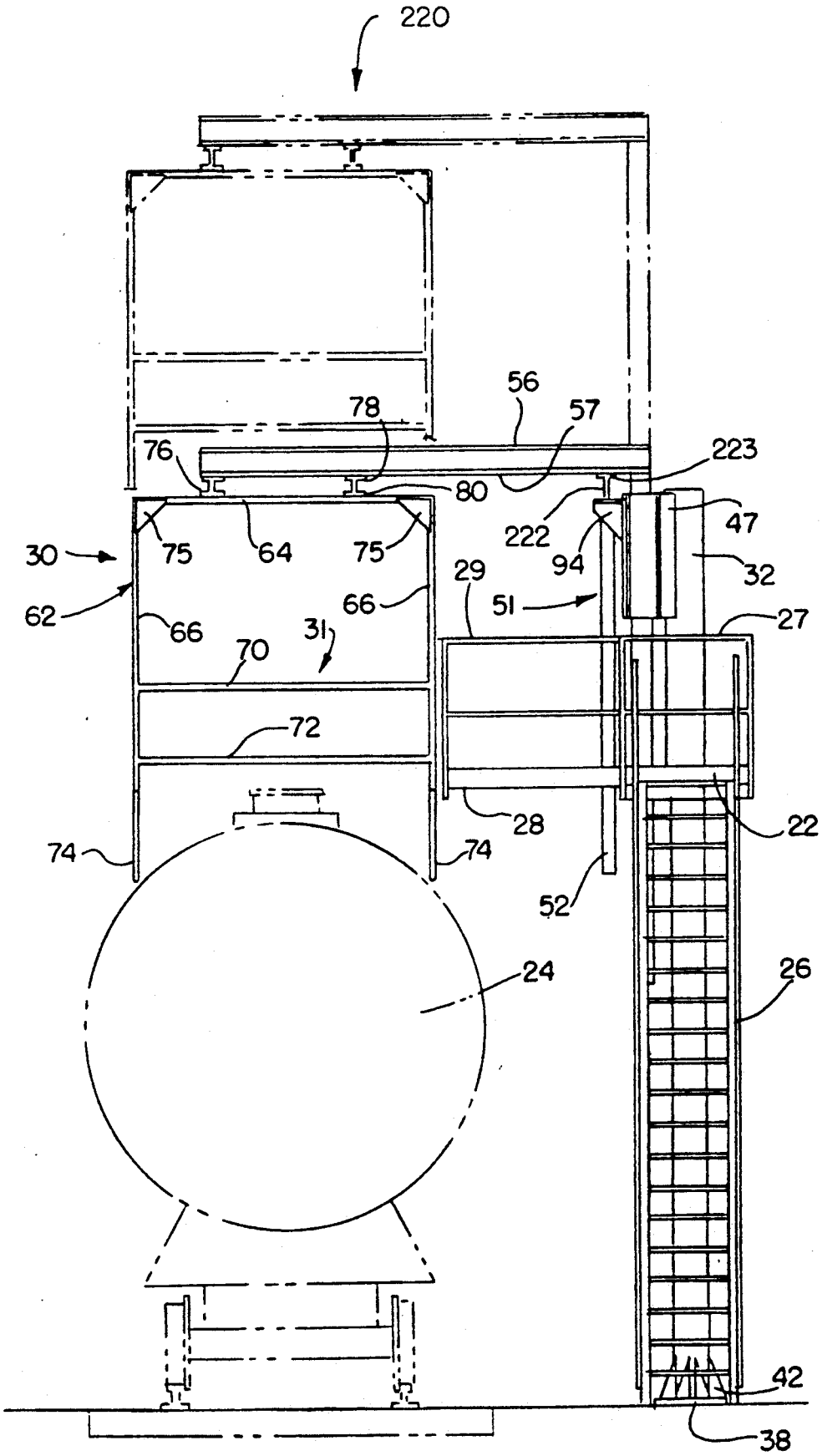
FIG. 7 is an end view of another preferred embodiment of the invention positioned above a tank car.

Referring now to FIG. 7, a safety railing system 220 is shown. The system is similar to that of FIGS. 1–3 (system 20), however the vertical movement unit 51 consists of a hydraulic cylinder 222 with a piston 223 attached to the lower flange of the cantilever arm. The piston is designed to vertically move the safety railing system 220 approximately 8 feet.

In operation the safety railing systems of the present invention are normally initially in their up position (i.e. a position in which the safety railing frame is elevated above the mobile vehicle). After the tank truck or tank car is properly positioned, the operator either from on the platform or below the platform may then lower the safety railing frame. Once the vertical safety railing frame contacts the top of the mobile equipment, the vertical movement of the safety railing assembly may be stopped either manually or automatically. The safety railing system then provides a safety railing enclosed area for working on top of the vehicle. After whatever work is completed, the operator climbs back onto the platform. The safety railing system is then again elevated to its upper position, permitting the truck to be pulled away.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A vertically movable safety railing system for providing a safety railing enclosed area on top of a mobile equipment such as tank trucks and the like, comprising:

a stationary platform;

a vertically extending structural member; and a safety railing assembly mounted to said structural member;

said safety railing assembly including a safety railing cage having an open bottom;

said safety railing assembly also including vertical movement means for vertically moving said safety railing cage relative to said structural member between an elevated position where said safety railing cage clears such mobile equipment and a lower position which is substantially parallel with said elevated position and where said safety railing cage substantially contacts such equipment thereby enclosing a portion of the top of such equipment to provide such safety railing enclosed area.

2. A safety railing system as set forth in claim 1 wherein said system further comprises a foldable gangway attached at one end to said stationary platform and retractable to and from the top of such mobile equipment when said safety railing is in said lower position.

3. A vertically movable safety railing system for providing a safety railing enclosed area on top of a mobile equipment such as tank trucks and the like, comprising:

a stationary platform;

a vertically extending structural member; and a safety railing assembly mounted to said structural member;

said safety railing assembly including a safety railing cage having an open bottom;

said safety railing assembly also including vertical movement means for vertically moving said safety railing cage relative to said structural member between an elevated position where said safety railing cage clears such mobile equipment and a lower position where said safety railing cage substantially contacts such equipment thereby enclosing a portion of the top of such equipment to provide such safety railing enclosed area, said safety railing assembly also including:

a carrier having a hollow center mounted to said structural member;

a mast extending through said hollow center and movably mounted to said vertical motion means; and a cantilever arm connecting said mast and said cage.

4. A safety railing system as set forth in claim 3 wherein said vertical movement means is mounted to said carrier.

5. A vertically movable safety railing system as set forth in claim 4 wherein said vertical movement means includes a reversible motor and a worm gear screw jack driven by said motor; said jack secured to said cantilever arm.

6. A safety railing system as set forth in claim 4 wherein said vertical movement means includes a hydraulic cylinder having a piston; said piston secured to said cantilever arm.

7. A safety railing system as set forth in claim 4 wherein said cage includes horizontal top rail sections, vertical rail sections secured to and extending perpendicularly downward from each top member and horizontal handrails transversing the vertical rail sections.

8. A safety railing system as set forth in claim 7 wherein said horizontal rail sections are welded to said vertical rail sections.

9. A safety railing system as set forth in claim 7 wherein said system further comprises two top members being I-beams with an upper flange and a lower flange, said upper flange secured to said cantilever arm, said lower flange secured to said horizontal top rail sections, whereby said mast and said cage are connected.

10. A vertically movable safety railing system for providing a safety railing enclosed area on top of a mobile equipment such as tank trucks and the like, comprising:

a stationary platform;

a vertically extending structural member; and a safety railing assembly mounted to said structural member;

said safety railing assembly including a safety railing cage having an open bottom;

said safety railing assembly also including vertical movement means for vertically moving said safety railing cage relative to said structural member between an elevated position where said safety railing cage clears such mobile equipment and a lower position where said safety railing cage substantially contacts such equipment thereby enclosing a portion of the top of such equipment to provide such safety railing enclosed area, said system further comprising a canopy attached to an upper end of said structural member above said carrier, said canopy extending outward over said safety railing enclosed area.

11. A vertically movable safety railing system for providing a safety railing enclosed area on top of a mobile equipment such as tank trucks and the like, comprising:

a stationary platform;

two vertically extending structural members; and a safety railing assembly mounted to said structural members;

said safety railing assembly including a safety railing cage having an open bottom; said safety railing assembly also including vertical movement means for vertically moving said safety railing cage relative to said structural members between an elevated position where said safety railing cage clears such mobile equipment and a lower position which is substantially parallel with said elevated position and where said safety railing cage substantially contacts such equipment thereby enclosing a portion of the top of such equipment to provide such safety railing enclosed area.

12. A safety railing system as set forth in claim 11 wherein said safety railing system further comprises a foldable gangway attached at one end to said stationary platform and retractable to and from the top of such mobile equipment when said safety railing is in said lower position.

13. A vertically movable safety railing system for providing a safety railing enclosed area on top of a mobile equipment such as tank trucks and the like, comprising:

a stationary platform;

two vertically extending structural members; and a safety railing assembly mounted to said structural members;

said safety railing assembly including a safety railing cage having an open bottom; said safety railing assembly also including vertical movement means for vertically moving said safety railing cage relative to said structural members between an elevated position where said safety railing cage clears such mobile equipment and a lower position where said safety railing cage substantially contacts such equipment thereby enclosing a portion of the top of such equipment to provide such safety railing enclosed area, said safety railing assembly further including:

two carriers having hollow centers, one carrier mounted on each structural member;

two masts, one mast extending through each of said hollow centers and each mast movably mounted to said vertical motion means; and two cantilever arms connecting said masts to said cage.

14. A safety railing system as set forth in claim 13 wherein said vertical movement means is mounted to said carriers.

15. A safety railing system as set forth in claim 14 wherein said vertical movement means includes two reversible motors and two worm gear screw jacks driven by the motors; one jack being secured to each of said cantilever arms.

16. A safety railing system as set forth in claim 14 wherein said vertical movement means includes two hydraulic cylinders having pistons, said pistons secured to said cantilever arms.

17. A safety railing system as set forth in claim 14 wherein said cage includes horizontal top rail sections, vertical rail sections secured to and extending perpendicularly downward from each top member and horizontal handrails transversing the vertical rail sections.

18. A safety railing system as set forth in claim 17 wherein said horizontal rail sections are welded to said vertical rail sections.

19. A safety railing system as set forth in claim 17 wherein said system further comprises two I-beam top members having upper flanges and lower flanges, said upper flanges secured to said cantilever arms, said lower flanges secured to said horizontal top rail sections.

20. A vertically movable safety railing system for providing a safety railing enclosed area on top of a mobile equipment such as tank trucks and the like, comprising:

a stationary platform;

two vertically extending structural members; and a safety railing assembly mounted to said structural members;

said safety railing assembly including a safety railing cage having an open bottom; said safety railing assembly also including vertical movement means for vertically moving said safety railing cage relative to said structural members between an elevated position where said safety railing cage clears such mobile equipment and a lower position where said safety railing cage substantially contacts such equipment thereby enclosing a portion of the top of such equipment to provide such safety railing enclosed area, said system further comprising a canopy attached to an upper end of said structural members above said carrier, said canopy extending outward over said safety railing enclosed area.

* * * * *